United States Patent [19]

Dougherty et al.

[11] 4,300,071

[45] Nov. 10, 1981

[54] FOUR-CORNER SHADOW MASK SUSPENSION SYSTEM FOR TELEVISION CATHODE RAY TUBES

[75] Inventors: Lawrence W. Dougherty, Sleepy Hollow; Kazimir Palac, Carpentersville, both of Ill.

[73] Assignee: Zenith Radio Corporation, Glenview, Ill.

[21] Appl. No.: 101,959

[22] Filed: Dec. 10, 1979

[51] Int. Cl.[3] ..... H01J 29/80

[52] U.S. Cl. ..... 313/407; 313/404; 313/406

[58] Field of Search ..... 313/407, 402, 404, 405, 313/406, 408, 292, 284

[56] References Cited

U.S. PATENT DOCUMENTS

| | | | |
|---|---|---|---|
| 2,922,063 | 1/1960 | Haas . | |
| 2,961,560 | 11/1960 | Fyler . | |
| 3,450,920 | 6/1969 | Engels et al. . | |
| 3,487,251 | 12/1969 | Barten et al. | 313/292 X |
| 3,497,746 | 2/1970 | Duistermaat et al. . | |
| 3,529,199 | 9/1970 | Duistermaat et al. . | |
| 3,548,235 | 12/1970 | Driedijk et al. . | |
| 3,553,517 | 1/1971 | DeBernardis | 313/406 |
| 3,588,568 | 6/1971 | Sohn | 313/402 X |
| 3,803,436 | 4/1974 | Morrell | 313/406 X |
| 3,943,399 | 3/1976 | Sedivy . | |
| 3,986,071 | 10/1976 | Groot | 313/406 X |
| 3,986,072 | 10/1976 | Adamski . | |
| 3,999,098 | 12/1976 | Dougherty . | |
| 4,100,451 | 7/1978 | Palac . | |

FOREIGN PATENT DOCUMENTS

| | | | |
|---|---|---|---|
| 54-129877 | 10/1979 | Japan | 313/407 |
| 1172334 | 11/1969 | United Kingdom . | |
| 1189403 | 4/1970 | United Kingdom . | |
| 1278633 | 6/1972 | United Kingdom . | |
| 1278634 | 6/1972 | United Kingdom . | |
| 1278635 | 6/1972 | United Kingdom . | |

*Primary Examiner*—Stanley T. Krawczewicz
*Attorney, Agent, or Firm*—Ralph E. Clarke, Jr.

[57] ABSTRACT

An improved low-cost mask-faceplate assembly for a shadow-mask-type color cathode ray tube is disclosed. The assembly comprises a glass faceplate having a dished central section and a rearwardly extending flange. A substantially rectangular, frameless shadow mask has a dished perforate central section and rearwardly extending skirt. The mask is relatively stiff about its major and minor axes, but torsionally flexible and unstable with respect to its diagonals. The mask has an integral rim extending radially outward from the edge of the mask skirt to serve as an electron beam shield and to provide added stiffness for the mask. A corner mask suspension system consists of four suspension devices, one at each corner of the mask. Each device comprises a stud affixed to the faceplate flange and arranged to extend radially inwardly along the diagonal of the faceplate. A leaf spring is provided for detachably inter-connecting the mask corner to the stud. Means are provided for mounting the spring on the mask diagonal and normal to the diagonal so that the spring extends rearwardly away from the central section of the faceplate, and such that when the spring is deflected, the distal end thereof travels on an arc inwardly toward the faceplate central axis. As a result, the mask, which is low in cost but inherently lacking in self-rigidity and stability due to its one-piece frameless construction, is suspended with high rigidity derived from the faceplate and with high stability derived from the four-corner mounting. Further, the rearwardly extending springs have their distal ends readily accessible for facile insertion and removal of the mask from the faceplate.

7 Claims, 7 Drawing Figures

FOUR-CORNER SHADOW MASK SUSPENSION SYSTEM FOR TELEVISION CATHODE RAY TUBES

CROSS-REFERENCE TO RELATED APPLICATIONS

This application is related to but in no way dependent upon copending application Ser. No. 24,272 filed Mar. 26, 1979 of common ownership herewith.

BACKGROUND OF THE INVENTION AND PRIOR ART DISCLOSURE

This invention relates in general to color-reproducing television cathode ray tubes and more particularly to means for suspending a novel color selection electrode or "shadow mask" in proper adjacent parallelism to the faceplates of such tubes.

The conventional color selection electrodes or "shadow mask" comprises a dished apertured mask which is welded to a rigid frame that imparts the necessary rigidity for the dished section. This type of mask-frame assembly is mounted in close adjacency to the faceplate of the cathode ray tube by a suspension system comprising three or four leaf springs. The springs are welded to the frame at selected points around the periphery. Because of the weight of the mask, it is necessary that the springs be relatively stiff; this stiffness results in the application of a load directed radially inwardly of up to four or five pounds to the mask-frame assembly. The distal ends of the springs are apertured to engage studs which project inwardly from the rearwardly extending flange of the tube faceplate. It is necessary that the mask-frame assembly be capable of being demounted several times, and remounted with exact precision in relation to the faceplate; this demounting and mounting is required in the manufacturing process. Demounting is accomplished by depressing the springs to disengage the studs, usually by automatic machinery. In remounting, the shadow mask and the faceplate are brought into propinquity whereby the springs are caused to re-engage the studs.

The type of mask described; that is, one having a heavy, rigid frame which in turn provides the necessary rigidity to the dished, apertured mask, has significant disadvantages despite its proved commercial viability. The disadvantages include costliness, excessive mass, heavy weight, and the tendency to distort upon heating under the impact of the cathode ray tube electron beams. As a result of this distortion, it has been necessary to design elaborate and costly shadow mask suspension systems wherein bimetallic components provide the necessary "Q-spacing" to compensate for such heating. Q-spacing is defined as the spacing between the shadow mask and the phosphor screen. The Q-spacing must be accurately maintained in order for proper registration of mask apertures with the associated phosphor stripes (or dots).

The problem inherent in a rigid mask design as described has led to the invention of a low cost, lightweight, non-self-rigid, torsionally flexible shadow mask, preferably of one-piece, frameless construction. A shadow mask of this type is disclosed in U.S. Pat. No. 4,100,451 to Palac, of common ownership herewith, wherein an approximately rectangular, flangeless curved faceplate supports on a concave inner surface thereof in a central region a phosphor screen comprising patterns of red-, blue-, and green-emissive phosphor triads. The low mass, approximately rectangular, non-self-rigid, torsionally flexible shadow mask has a central portion with a pattern of electrontransmissive apertures in registry with the patterns of phosphor triads. The mask has a rim portion providing substantial rigidity with respect to axes normal to the sides thereof, while providing for flexure of the mask with respect to its diagonals. The mask suspension system establishes a predetermined position of the mask relative to, and at a predetermined spacing from, the inner surface of the faceplate. The system includes four suspension means for mechanically coupling the mask directly to the corner portions of the faceplate. The suspension means are located on at each corner of the mask to permit the mask to flex about its diagonals and conform to the contour of the faceplate despite any twist-wise deformation thereof. By this means, the predetermined spacing between the mask and the faceplate inner surface is maintained.

The present invention is an improvement of a suspension system for a low cost, light weight, non-self-rigid, torsionally flexible mask, which is compatible with the standard flanged face panel design. The faceplate is used to impart the necessary rigidity to the mask. The novel suspension system furnishes a mechanically rigid link between the faceplate and the mask, and yet permits the mask to be conveniently and repeatably demounted and precisely remounted in the tube.

There are a number of basic requirements imposed upon any mask suspension system. The first requirement, a general one, is that the suspension system must be able to adapt to normal "out of plane" errors of the four panel-mounted studs and to twist-wise deformations of the faceplate with which it is mated, and which may occur during the manufacturing process. The mask must be capable of flexing or twisting about its diagonals in much the same way that a faceplate is apt to twist-wise deform in contour during tube fabrication, and its suspension system must provide for such adaptation.

Second, and of equal significance—with respect to any given faceplate, since the mask is non-self-rigid, the suspension system for the mask must effectively transfer the rigidity of the faceplate to the mask.

Third, the suspension system must precisely fix and hold a predetermined spatial position of the mask as a whole relative to the faceplate against translational or rotational displacement in spite of any thermal expansion or contraction of the mask, frictional restraint during demounting and remounting of the mask, mechanical shocks, and force of gravity.

Fourth, it is desirable that any thermally induced movement of any part of the mask or of any mask suspension element during tube operation be radial rather than tangential, since radial errors can be compensated by adjusting in the beam deflection characteristic, whereas tangential errors cannot be.

Fifth, it is desirable that the system permit the mask to be conveniently and quickly demounted and remounted, preferably automatically, since in conventional factory faceplate screening practices the mask is mounted on or demounted from the faceplate many times.

A sixth general requirement is that the mask suspension system should carry a low manufacture cost. A different type of shadow mask and suspension system thereof is disclosed in the patent to Fyler—U.S. Pat.

No. 2,961,560. This patent shows a frameless shadow mask supported at a multiplicity of spaced peripheral points directly on projections from the concave screen-bearing surface of the tube faceplate. By this approach, it would appear that the rigidity of the faceplate is used to impart rigidity to the mask, thus eliminating the necessity for the mask to also be rigid. The Fyler approach would appear to suffer, however, (1) from an intolerable difficulty and inconvenience in the demounting and remounting of the shadow mask in the tube, an operation performed many times on conventional faceplate screening practices; (2) a difficulty in seating and reseating the mask uniformly on the multiplicity of support elements provided on the faceplate; (3) uncontrollability of the spatial position of the mask corners, and thereby a loss of color purity in the corners of the displayed images; (4) a probable shifting of the geometrical center of the mask upon thermal expansion and contraction thereof due to the non-equalized, frictional retention of the mask in the Fyler mask mounting system; (5) difficulty in achieving a commercially satisfactory Q-compensation of the mask if such is necessary, and (6), a relatively high cost of system manufacture and assembly.

As will be pointed out in more detail hereinafter, this invention involves the provision of a shadow mask suspension system comprising four suspension devices, one at each corner of the tube faceplate with each device including an axially extending, cantilevered leaf spring. It has been found that numerous additional specific requirements are imposed upon such a system, devolving in part from the corner location of the suspension devices, and in part from the use of a cantilevered-type spring as an element of the device.

A seventh specific requirement is as follows. In order to achieve the afore-discussed fixing of the spatial position of the mask, in the context of a four-corner cantilevered spring suspension system as described, it has been discovered that at least three of the springs must be reasonably stiff in the plane of the spring. If the mask suspension springs are not sufficiently stiff in the plane thereof; i.e., in the tangential direction as mounted, and preferably (though not necessarily) in torsion also, the mask will not always return to its bogey position (nominal assigned position) after having received a mechanical shock or after having been demounted and remounted. This fact is due largely to the mass of the mask and to friction at the points of engagement of the mask-mounted and envelope-mounted components of the mask suspension devices.

An eighth important requirement of the mask suspension system is that it provide a relatively constant and relatively low-value radial spring loading on the mask, without the imposition of any significant moment tending to twist or deform the mask. Yet the mask must be supported against mechanical shocks which, e.g., may apply 45 G's or more to the mask. This requirement is especially important in a suspension system designed, as the present system is, especially for use with a lightweight, non-self-rigid mask capable of being distorted or deformed by an excessive loading or by a moment loading thereof.

A ninth (specific) requirement is that, in order that the suspension device not occupy a large area in the corner of the faceplate, which would require the provision of a larger-than-desired faceplate (and associated funnel), the deflection of the leaf spring to effect engagement or disengagement of the mask from the faceplate must be quite small. Further, the spring must not be so large as to require the provision of an intolerably great amount of space in the corner of the faceplate to accommodate the spring.

Tenth, the spring must be of a thickness, for certain embodiments of the invention, to be suitable for welding to a supporting structure. Further, the spring must not be over-stressed during demounting or remounting of the mask, and during thermal cycling of the tube during tube fabrication.

A prior art patent to Haas—U.S. Pat. No. 2,922,063—discloses a suspension system for a shadow mask which appears in some respects similar and in other respects very different from the suspension system of the present invention. Haas discloses a shadow mask having a lightweight frame to which is attached a perforated color-selection mask. The mask is suspended adjacent to concave inner surface of a faceplate of the type having a rearwardly extending flange.

A suspension system is shown for suspending the mask which comprises four suspension devices located on the major and minor axes of the faceplate, each suspension device including a relatively wide leaf spring which is attached to the faceplate adjacent the seal land and extending forwardly to the mask frame. The springs are said to be "thin, flat metallic strips so that they are stiff in a lateral dimension but flexible in a direction perpendicular to the major flat face" (column 3, lines 48–51).

The Haas system is considered to have a number of major shortcomings which have perhaps been responsible for its apparent failure to have achieved commercial use. Each leaf spring is apparently so flexible out of its own plane as to require that it be either screwed to a sealed-in flange (FIG. 4) or held on a faceplate-embedded stud by means of a special spring clip (55 in FIG. 5). In either arrangement, it is possible that any thermal expansion of the mask of frame would result in a moment being applied to the mask-frame assembly which would distort the mask and produce color impurity in the displayed images.

The Haas system would be further unsuited for use in the present system for failure to meet the aforedescribed first, fifth, and ninth requirements, and perhaps others.

Yet another prior art approach is expounded by U.S. Pat. Nos. 3,450,920; 3,497,746; 3,529,199; 3,548,235; British No. 1,278,633; British No. 1,278,634; British No. 1,278,635 and British No. 1,172,334. In these systems, a shadow mask having a deep-drawn integral mask skirt, either with or without a frame, is mounted adjacent to the concave inner screen-bearing surface of a faceplate of the type having a rearwardly extending flange. Numerous ways are shown by which such a mask may be suspended on the faceplate flange by means of mask-mounted elements which are received in recesses formed integrally in the faceplate flange. In certain embodiments, the recesses are suggested for location on the faceplate flange sides. In other embodiments it is suggested that the recesses be located in the faceplate flange corners. The basic approach described in these patents would be totally incapable of meeting a number of the basic requirements imposed on a system of the type with which this invention is involved, described above. As a practical matter, it is impossible to consistently and repeatedly achieve the necessary accuracy in mask-to-faceplate registration in any mask suspension system in which large and unpredictable friction forces are produced. U.S. Pat. No. 3,529,199 to Duistermaat et al also discloses a more conventional stud-spring suspension system (FIG. 2) but this too is deemed to be ineffective in meeting the needs of a system of the type with which this invention is concerned.

U.S. Pat. No. 3,999,098 to Dougherty discloses an embodiment of an invention wherein a non-self-rigid shadow mask is shown as providing for mounting in conjunction with a flanged faceplate. The system provides for four corner-located mask suspension devices which are attached to studs embedded one in each corner of the rearward flange of the faceplate. The shadow mask is characterized by having a integral skirt which flares outwardly to shield the screen from stray and overscanned electrons. The skirt and an integrally formed channel and edge lip enhance the stiffness of the mask with respect to its major and minor axis, while permitting the mask to flex with respect to its diagonals. The system includes suspension springs which extend forwardly in an orientation which would appear to preclude facile mounting and demounting of the mask.

U.S. Pat. No. 1,189,403 to Phillips Electronics and Associated Industries Limited, discloses a color television picture tube wherein a shadow mask is provided with a transversely protruding peripheral flange-like wall extending away from the associated faceplate. The mask, which is four-corner-mounted by means of four support springs, is reputedly secured in the tube without the use of a supporting frame. One end of each spring is welded to a wall extending from the mask. At the opposite end of each spring is attached a pin which enters an associated hole (or alternatively, a groove) located in the faceplate flange, and formed by drilling. The support springs are designed to lie at an angle of approximately one-half the deflection angle of the tube; this choice of angle is said to cause the mask to move toward the screen when the mask is heated under electron bombardment. Drawbacks to the system include the relatively short length of the springs. The stiffness of the springs and the resulting pressure on the mask could overflex the mask upon engagement and disengagement with the faceplate. Also, the relatively acute angle of the spring could result in translational misalignment upon vibration, and disengagement of the springs when the tube is face-dropped. Further, the mask flanges appear to restrict access to the springs, which must be retracted towards the mask during engagement and disengagement with the faceplate. Welding springs of such design directly to a relatively tiny area of the relatively thin metal of the mask, as indicated by FIG. 1 of the disclosure, may result in distortion of the mask due to induced stresses.

U.S. Pat. No. 3,943,399 to Sedivy, assigned to the assignee of the present invention, depicts suspension systems for detachably supporting a rectangular non-self-rigid, torsionally flexible shadow mask on the envelope of a color cathode ray tube. The suspension system comprises four corner-located mounting springs. In the preferred embodiment illustrated, the envelope-mounted means and the mask-mounted means mate with a snap-in, self-guiding, self-locating engagement means such that the mask may be mounted on the envelope by a push-click insertion operation. The suspension springs comprise loops extending between the mask frame and supporting studs and they would seem to occupy an untoward amount of space. Stability of such a mask assembly appears questionable.

U.S. Pat. No. 3,986,072 Adamski discloses a four-corner system for suspending a shadow mask having an integral skirt in proper spaced adjacency to a flangeless faceplate. In one embodiment, the suspension system includes a modified stud having a pair of legs which are embedded one in each corner of the rearwardly extending flange of a flanged faceplate (FIG. 17). The forward-facing suspension springs, which are attached to a bracket at one end and mated with studs at the other, are relatively short and wide, and hence relatively stiff. The integral skirt is cut away at the corners to provide clearance for the stud which is embedded in an extension of the screen-bearing inner surface of the faceplate. This embodiment, while feasible, lacks practicality for the present application in that the forewardly disposed suspension springs are in a relatively inconvenient location and orientation for easy and facile mounting and demounting of the mask.

OBJECTS OF THE INVENTION

It is a general object of this invention to provide an improved shadow mask-faceplate assembly for television cathode ray picture tubes.

It is a less general object to provide a system for the four-corner suspension of a frameless, torsionally flexible, non-self-rigid shadow mask in conjunction with a standard-type faceplate having a rearwardly extending flange.

It is a more specific object of the invention to provide such a mask suspension system in which the constituent suspension devices are compact and unobtrusive, and are thus particularly suited for the four-corner-mounting of a frameless shadow mask in conjunctive alignment with a standard-type faceplate having a flange.

It is a specific object to provide such a suspension system for a frameless shadow mask that precisely fixes and holds a predetermined spatial position of the mask relative to the flanged faceplate position against translational and rotational displacement in spite of any thermal expansion or contraction of the mask, frictional restraint during demounting and remounting of the mask, or mechanical shocks.

It is another specific object of the invention to provide a shadow mask suspension system which makes the corner-mounted suspension springs easily accessible.

BRIEF DESCRIPTION OF THE DRAWINGS

The features of the present invention which are believed to be novel are set forth with particularity in the appended claims. The invention, together with objects and advantages thereof, may best be understood, however, by reference to the following description taken in conjunction with the accompanying drawings, in the several figures of which like reference numerals identify like elements and in which:

DESCRIPTION OF THE PREFERRED EMBODIMENT

The present invention provides for suspension of the aforedescribed frameless shadow mask in conjunction with the faceplate of standard-type configuration having a rearwardly extending flange. The faceplate is used to impart the necessary rigidity to the non-self-rigid, torsionally flexible mask. The novel suspension system furnishes a mechanically rigid link between the faceplate and the mask, and yet permits the mask to be conveniently and repeatably demounted and precisely remounted with respect to the faceplate.

Figure 1:
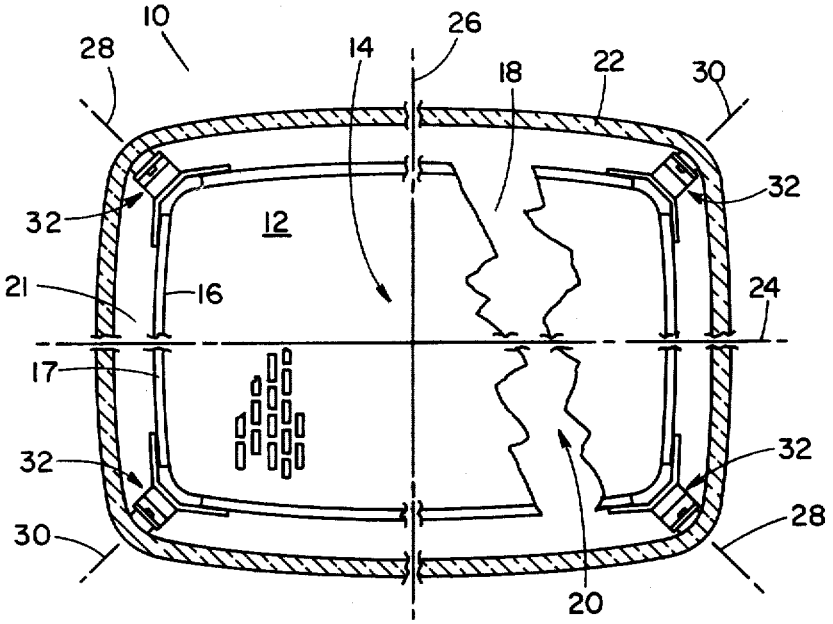
FIG. 1 is a plan view of the faceplate-shadow mask assembly with a partially cut away shadow mask, and showing a novel corner mask suspension system according to the invention.

FIG. 1 depicts an improved low cost mask-faceplate assembly according to the invention for a shadow-mask-type color cathode ray tube. The assembly 10 comprises a substantially rectangular, frameless shadow mask 12 having a dished perforate central section 14 and a rearwardly extending skirt 16. Mask 12 has an integral rim 17 extending radially outward from the rear edge of the mask skirt 16; integral rim 17 serves as an electron beam shield and provides added stiffness to mask 12. Mask 12 is relatively stiff about its major axis 24 and minor axis 26, but torsionally flexible and unstable with respect to diagonals 28 and 30. Shadow mask 12 is shown as cut away in FIG. 1 to reveal a glass faceplate 18 having a dished central section 20. Faceplate 18 has a rearwardly extending flange 22.

A corner mask suspension system according to the invention for rigidly and stably suspending mask 12 from the dished central section 20 of faceplate 18 is shown as comprising four suspension devices 32. One such device is located at each corner of the mask 12 to provide four-corner mounting. In consequence of the four-corner mounting system, the mask, which is low in cost but inherently lacking in self-rigidity due to its one-piece, frameless construction, is suspended with high rigidity derived from flanged faceplate 18, and high stability derived from the four-corner, diagonal mounting.

Figure 2:
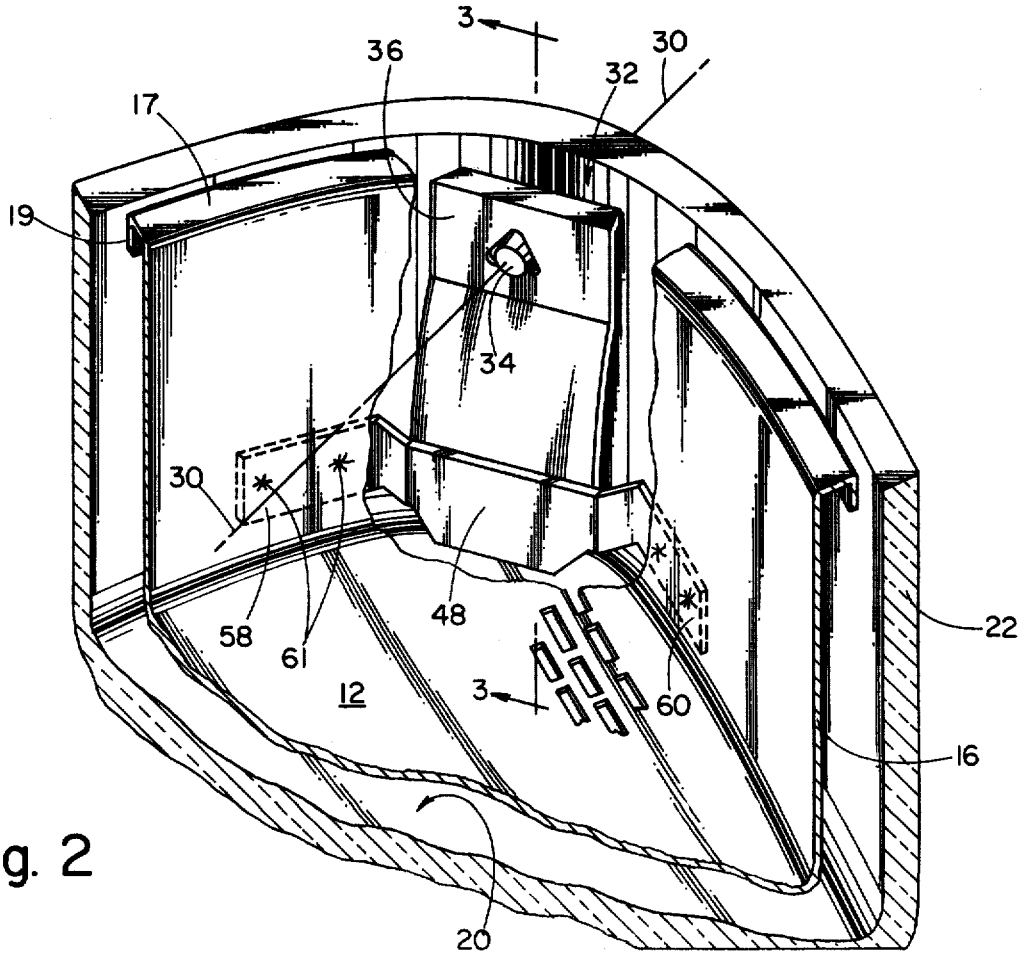
FIG. 2 is an oblique view in perspective of a corner of a faceplate with the shadow mask partially cut away to show details of an embodiment of the corner mask suspension system according to the invention.
Figure 3:
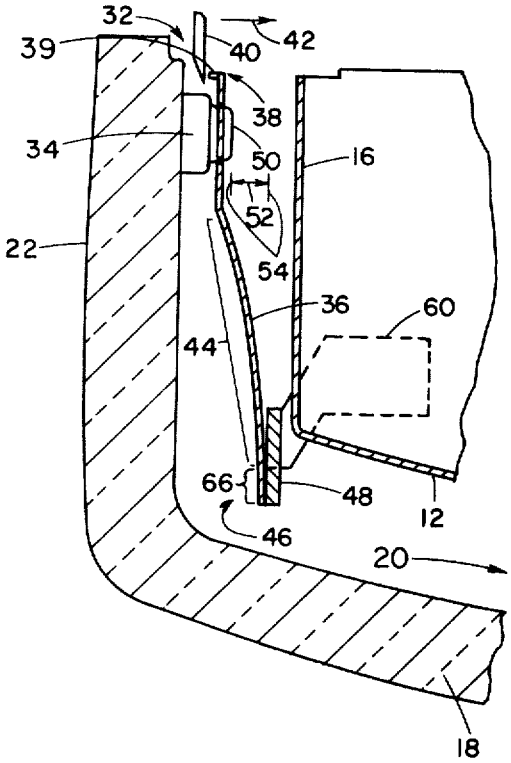
FIG. 3 is an enlarged fragmentary, partially cut away side view in section taken along lines 3—3 of FIG. 2, showing details of a corner mask suspension system constructed in accordance with the principles of this invention.

With reference now to FIGS. 2 and 3 in addition to FIG. 1, there is shown in detail a corner mask suspension device 32 and associated components. A lip 19 may extend downwardly from rim 17; lip 19 adds stiffness to mask 12. A stud 34 is shown as being affixed to the faceplate flange 22 on the associated faceplate diagonal 30. Stud 34 is arranged to extend radially inwardly along diagonal 30, as indicated.

A leaf spring 36 provides for detachably interconnecting the corner of mask 12 to stud 34 on the rearwardly extending flange 22 of faceplate 18. Means are provided for mounting leaf spring 36 on mask diagonal 30 and normal to diagonal 30 such that spring 36 extends rearwardly away from the dished central section 20 of faceplate 18.

This configuration is disclosed in referent copending Application Ser. No. 24,272.

With specific reference to FIG. 3, it will be observed that then spring 36 is deflected, distal end 38 will travel on an arc inwardly toward the faceplate central axis, as indicated by arrow 42. Rearwardly extending leaf spring 36 will be seen to have its distal end 38 readily accessible for facile insertion and removal of mask 12 from faceplate 18. It will be observed that the distal end 38 of spring 36 has a radially extending lip 39. This configuration is a subject of referent copending Application Ser. No. 24,272 filed Mar. 26, 1979.

The process of manufacture of a color television picture tube having a shadow mask wherein a successive application of the color phosphors and other screening fluids to the inner surface of the faceplate is required, makes it necessary that the shadow mask assembly be removed from the faceplate and inserted in proper registration several times. Ideally, the mask suspension means is designed to ensure that the shadow mask is returned to its exact position in relation to the associated screen upon each replacement. Removal is accomplished by the automatic apparatus by means of a finger which engages a distal end of the support spring, and typically moves radially inwardly to disengage the spring from the associated stud. A finger 40 suitable for disengaging spring 36 from stud 34 is indicated by FIG. 3. Arrow 42 indicates the direction of excursion of finger 40 in disengaging leaf spring 36 from stud 34. It will be seen that the rearwardly extending spring 36 according to the invention has its distal end 38 readily accessible for facile insertion and removal of the mask from the faceplate. The extending of spring 36 rearwardly away from the central section of the faceplate according to the invention and as indicated by FIG. 3, makes possible an adequate excursion of spring 36 for complete disengagement of spring 36 from stud 34. It is to be noted that the extension of spring 36 rearwardly away from the central section of the faceplate is based upon the carefully calculated curve indicated by bracket 44. Too great a curvature of spring 36 results in lateral instability to shock, frictional forces, and force of gravity.

To enable suspension spring 36 to function effectively in the limited corner space available as a consequence of the combining of a frameless shadow mask as heretofore described with a standard-type flanged faceplate, a further compromise in spring configuration was needed to provide proper registration with adequate clearance with respect to the associated stud. The spring curvature 44 indicated by the bracket is designed so that when spring 36 is depressed to the full extent of the available space, adequate clearance between spring 36 and the tip of stud 34 will be obtained. The amount of such clearance for the configuration shown by FIG. 3 is indicated by arrow 52, which is shown as lying between extension lines 54 which spatially define the planes of the face 50 of stud 34 and end 46 of spring 36. The means according to the invention provide for an excursion of approximately 150 mils for the end 46 of spring 36, a distance which is adequate for easy and facile insertion and removal of the shadow mask 12.

Figure 4:
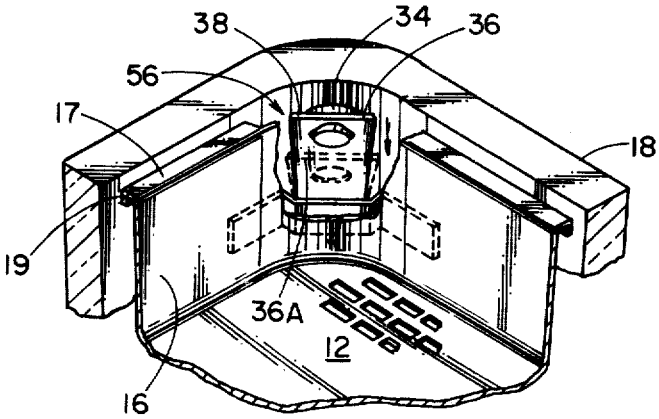
FIG. 4 is an oblique view in perspective of a corner-mask suspension system showing another embodiment of the invention.

With reference now to FIG. 4, another embodiment of the invention is shown wherein the rim 17 of mask 12 (and associated lip 19) is shown as being cut out in the corner region of mask 12. When spring 36 is deflected, as by the aforedescribed finger 40 of the automatic mask removal and insertion machinery, the distal end 38 of spring 36 travels on an arc inwardly toward the faceplate central axis and into cut-out 56 in the rim 31 of mask 12, as indicated. This excursion in an arc radially inwardly is indicated by the dashed line representation 36A of spring 36 shown by FIG. 4. Cut-out section 56, together with the ready accessibility of the distal end 38 of the rearwardly extending spring 36 according to the invention promotes facile insertion and removal of the mask 12 from the faceplate.

With reference again to FIG. 2, spring 36 is shown as being attached to bracket 48. Bracket 48 is shown as having two arms 58 and 60 extending around the corner of mask 12 and beneath the overhang of the mask rim 17. Arms 58 and 60 are welded to the adjoinging sides of skirt 16 of mask 12 to support spring 36 on mask diagonal 30 and normal to diagonal 30 such that spring 36 extends rearwardly away from the central section 20 of faceplate 18.

Figure 5:
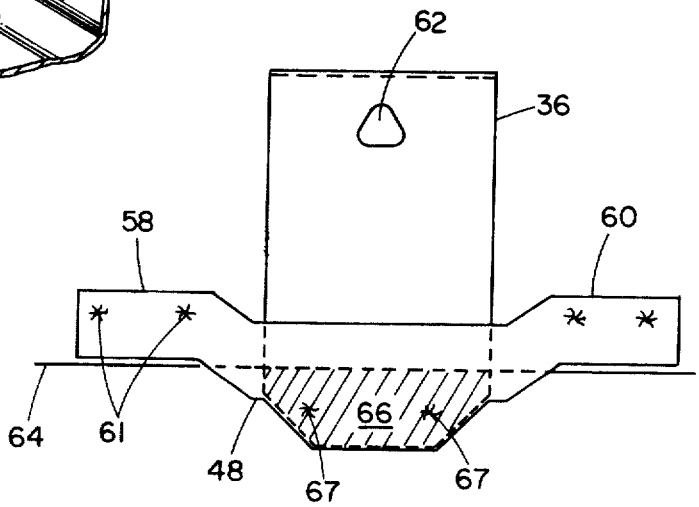
FIG. 5 is a plan view of a bracket-spring assembly for a corner mask suspension system illustrating another aspect of the invention.

A plan view of the bracket and spring assembly is shown by FIG. 5. To indicate the configuration of arms 58 and 60, the bracket 48 is shown with arms 58 and 60 in an unbent configuration, whereas they would normally extend around the corner of mask 12.

Aperture 62 provides for receiving stud 34. Weld points 67, which provide for permanent attachment of bracket 48 and spring 36, are indicated.

The spatial relationship of bracket 48 to the shadow mask 12 is indicated by mask profile line 64, which is indicated as lying behind the bracket-spring assembly. It will be seen that in accordance with this invention, by configuring bracket 48 to extend below the level of mask 12, as indicated by mask profile line 64, spring 36 may be designed to be appreciably longer (with the benefits of the longer spring configuration as described heretofore). As a result, when spring 36 is fully deflected, the extended length of the spring will aid in providing the benefits of firm mounting coupled with easy releasability of spring 36 from stud 34. The means according to the invention that make possible the longer spring are apparent from FIG. 5. Terminal point 66; that is, the area of attachment of spring 36 to bracket 48, is indicated by cross-hatching in FIG. 5, and by the brace symbol in FIG. 3. This configuration according to the invention, wherein spring 36 extends from terminal point 66 which is located at or forwardly of the dished central section of mask 12, permits a longer length of spring 36.

Figure 6:
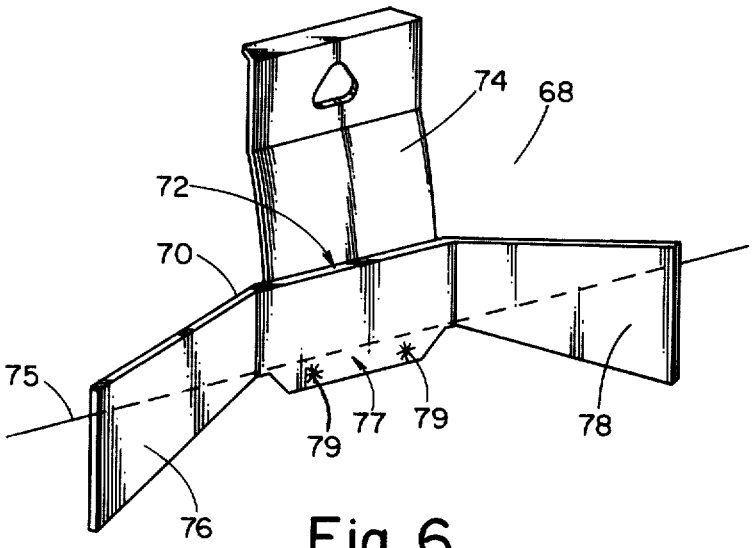
FIG. 6 is a view in perspective of yet another embodiment of a bracket-spring assembly for a corner mask suspension system according to the invention.

Another embodiment of the invention is shown by FIG. 6 wherein a bracket-spring assembly 68 is shown as comprising a gull-wing-shaped bracket member 70 having a planar center section 72. A pair of wings 76 and 78 are shown as being conformed to extend around the corner of a shadow mask (not shown) and beneath the overhang of the rim of the mask. Wings 76 and 78 are welded to the adjoining sides of the mask to strengthen the mask corner. As with the embodiment of the invention described and shown in connection with FIG. 5, the planar center section extends forwardly of the dished central section of the mask. The relative positions of bracket-spring assembly 68 and the shadow mask is indicated by shadow mask profile line 75 which is indicated as lying behind the bracket-spring assembly 68. Configuring bracket 70 to extend from a terminal point 77 at or forwardly of the dished central section of the mask permits spring 74 to be made longer. Weld points 79 provide for permanent attachment of bracket 70 and spring 74.

Figure 7:
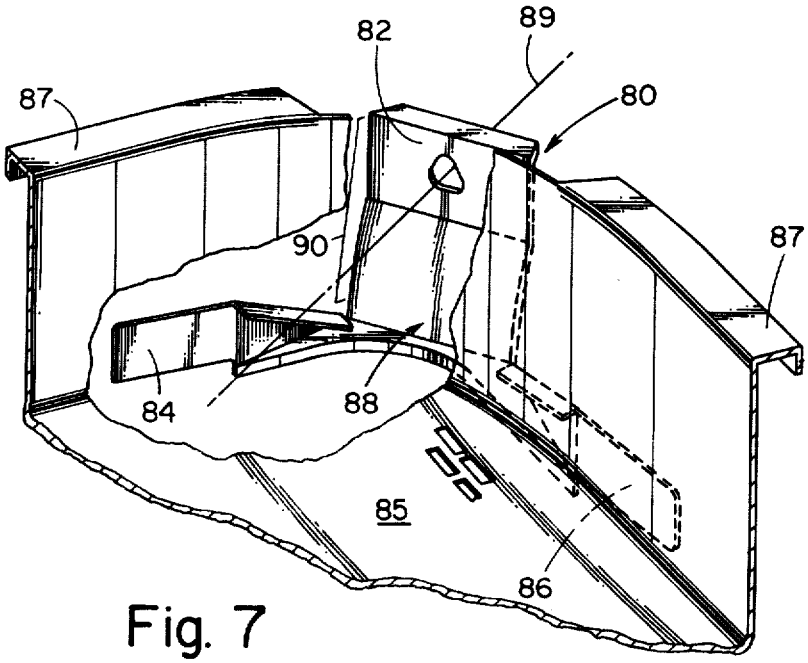
FIG. 7 is an oblique view in perspective of a further embodiment of a bracket-spring assembly for a corner mask suspension system according to the invention.

Another representation of the invention is shown by FIG. 7 which depicts a metal bracket-spring stamping 80. A leaf spring 82, which provides for detachably interconnecting the mask corner to the faceplate skirt by means of a stud, constitutes an integral part of the metal bracket-spring stamping 80. Stamping 80 has arms 84 and 86 extending around the corner of the mask 85 and beneath the overhang of the mask rim 87. Arms 84 and 86 are bonded as by welding to the adjoining sides of the mask to support spring 82 on the faceplate diagonal 89 and normal to diagonal 89 such that spring 82 extends rearwardly away from the central section of the faceplate. The rearward extension of spring 82 is from a terminal point 88 shown as being at the plane of the dished central section of mask 12. Alternately, terminal point 88 could as well be forwardly of the dished central section; that is, nearest the faceplate of the tube as noted in connection with FIGS. 5 and 6 and associated descriptions. By having spring 82 extend rearwardly away from the central section of the faceplate from a terminal point 88 at or forwardly of the dished central section of the mask according to the invention, the spring 82 of bracket-spring stamping 80 can be made relatively longer to provide the benefits accruing from a longer spring noted heretofore.

The material of which the various bracket configurations according to the invention are comprised may be, for example, cold rolled steel having a thickness of about 0.06 inch. The material from which the leaf springs are formed may comprise, for example, 17-7 PH stainless steel, condition "C", about 0.011 inch thick. Means to form and shape such brackets and springs well known to those skilled in the art include stamping, coining, bending, shearing, punching, piercing, etc. Bracket-spring stamping 80 can be formed in its entirety from a single piece of the 17-7 PH stainless steel described heretofore.

Other changes may be made in the above-described apparatus without departing from the true spirit and scope of the invention herein involved. It is intended therefore that the subject matter of the foregoing depiction shall be interpreted as illustrative and not in a limiting sense.

I claim:

1. An improved low-cost mask-faceplate assembly for a shadow-mask-type color cathode ray tube, comprising:

a glass faceplate having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals, said mask having an integral rim extending radially outwardly from the edge of said mask skirt to serve as an electron beam shield and to provide added stiffness for said mask; and a corner mask suspension system for rigidly and stably suspending said mask with said dished perforate central section of said mask spaced from said central section of said faceplate, said suspension system consisting of four suspension devices, one at each corner of the mask, each device comprising:

a stud affixed to said faceplate flange on the associated faceplate diagonal and arranged to extend radially inwardly along said diagonal;

a leaf spring for detachably interconnecting said mask corner to said stud on said faceplate flange;

means for mounting said spring on said mask diagonal and normal to said diagonal such that said spring extends rearwardly away from said central section of said faceplate, from a terminal point at or forwardly of said dished central section of said mask such that when said spring is deflected, the distal end thereof travels on an arc inwardly toward the faceplate central axis, whereby the mask, which is low in cost but inherently lacking in self-rigidity and stability due to its one-piece frameless construction, is suspended with high rigidity derived from said faceplate and with high stability derived from the four-corner diagonal mounting, said rearwardly extending springs having their distal ends readily accessible for facile insertion and removal of said mask from said faceplate.

2. An improved low-cost mask-faceplate assembly for a shadow-mask-type color cathode ray tube, comprising:

a glass faceplate having a dished central section and a rearwardly extending flange:

a substantially rectangular, frameless shadow mask having a dished perforate central section and a rearwardly extending skirt, said mask being relatively stiff about its major and minor axes, but torsionally flexible and unstable with respect to its diagonals, said mask having an integral rim extending radially outwardly from the edge of said mask skirt to serve as an electron beam shield and to provide added stiffness for said mask, said rim being cut out in the corner regions of said mask; and, a corner mask suspension system for rigidly and stably suspending said mask with said dished perforate central section of said mask spaced from said central section of said faceplate, said suspension system consisting of four suspension devices, oen at each corner of the mask, each device comprising:

a stud affixed to said faceplate flange on the associated faceplate diagonal and arranged to extend radially inwardly along said diagonal, a leaf spring for detachably interconnecting said mask corner to said stud on said faceplate flange;

means for mounting said spring on said mask diagonal and normal to said diagonal such that said spring extends rearwardly away from said central section of said faceplate with its distal end rearwardly of the mask for ready accessibility, and such that when said spring is deflected, the distal end thereof travels on an arc inwardly toward the faceplate central axis and into said cut-out of said rim;

whereby the mask, which is low in cost but inherently lacking in self-rigidity and stability due to its one-piece frameless construction, is suspended with high rigidity derived from said faceplate and with high stability derived from the four-corner diagonal mounting, the ready accessibility of the distal ends of the rearwardly extending springs promoting facile insertion and removal of said mask from said faceplate.

3. An improved low-cost mask-faceplate assembly for a shadow-mask-type color cathode ray tube, comprising:

a glass faceplate having a dished central section and a rearwardly extending flange;

a substantially rectagnular, frameless shadow mask having a dished perforate central section and a rearwardly extending skirt, said mask being relatively stiff about its major and minor axes, but torsionally flexible and unstable with respect to its diagonals, said mask having an integral rim extending radially outwardly from the edge of said mask skirt to serve as an electron beam shield and to provide added stiffness for said mask; and a corner mask suspension system for rigidly and stably suspending said mask with said dished perforate central section of said mask spaced from said central section of said faceplate, said suspension system consisting of four suspension devices, one at each corner of the mask, each device comprising:

a stud affixed to said faceplate flange on the associated faceplate diagonal and arranged to extend radially inwardly along said diagonal, a leaf spring for detachably interconnecting said mask corner to said stud on said faceplate flange;

bracket means having arms extending around the corner of said mask and beneath the overhang of the rim of said mask skirt, and welded to the adjoining sides of said mask, said bracket means providing for mounting said spring on said mask diagonal and normal to said diagonal such that said spring extends rearwardly away from said central section of said faceplate from a terminal point at or forwardly of said dished central section of said mask such that when said spring is deflected, the distal end thereof travels on an arc inwardly toward the faceplate central axis;

whereby the mask, which is low in cost but inherently lacking in self-rigidity and stability due to its one-piece frameless construction, is suspended with high rigidity derived from said faceplate and with high stability derived from the four corner diagonal mounting, said rearwardly extending springs having their distal ends readily accessible for facile insertion and removal of said mask from said faceplate.

4. An improved low-cost mask-faceplate assembly for a shadow-mask-type color cathode ray tube, comprising:

a glass faceplate having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals, said mask having an integral rim-and-lip extending radially outwardly from the rear edge of said mask skirt to serve as an electron beam shield and to provide added stiffness for said mask; and, a corner mask suspension system for rigidly and stably suspending said mask with said dished perforate central section of said mask spaced from said central section of said faceplate, said suspension system consisting of four suspension devices, one at each corner of the mask, each device comprising:

a stud affixed to said faceplate flange on the associated faceplate diagonal and arranged to extend radially inwardly along said diagonal;

a leaf spring for detachably interconnecting said mask corner to said stud on said faceplate flange, said spring constituting an integral part of a metal bracket-spring stamping, said stamping havng arms extending around the corner of said mask and beneath the overhang of the rim of said mask skirt, said arms being welded to the adjoining sides of the mask to support said spring on said mask diagonal and normal to said diagonal such that said spring extends rearwardly away from said central section of said faceplate from a terminal point at or forewardly of said dished central section, and such that when said spring is deflected, the distal end thereof travels on an arc inwardly toward the faceplate central axis;

whereby the mask, which is low in cost but inherently lacking in self-rigidity and stability due to its one-piece frameless construction, is suspended with high rigidity derived from said faceplate and with high stability derived from the four corner diagonal mounting, said rearwardly extending springs having their distal ends readily accessible for facile insertion and removal of said mask from said faceplate.

5. An improved low-cost mask-faceplate assembly for a shadow-mask-type color cathode ray tube, comprising:

a glass faceplate having a dished central section and a rearwardly extending flange, a substantially rectangular, frameless shadow mask having a dished perforate central section and a rearwardly extending skirt, said mask being relatively stiff about its major and minor axes, but torsionally flexible and unstable with respect to its diagonals, said mask having an integral rim extending radially outwardly from the edge of said mask skirt to serve as an electron beam shield and to provide added stiffness to said mask; and a corner mask suspension system for rigidly and stably suspending said mask with said dished perforate central section of said mask spaced from said central section of said faceplate, said suspension system consisting of four suspension devices, one at each corner of the mask, each device comprising:

a stud affixed to said faceplate flange on the associated faceplate diagonal and arranged to extend radially inwardly along said diagonal;

a bracket-spring assembly comprising a gull-wing shaped bracket member having a planar central section and a pair of arms extending around the corner of said mask and beneath the overhang of said mask flange, said arms being welded to the adjoining sides of the mask to strengthen the mask corner, said planar central section extending forwardly of said dished central section of said mask;

a leaf spring for detachably interconnecting said mask corner to said stud on said faceplate flange, said spring being welded to said central section of said bracket such that said spring is situated on said mask diagonal and normal to said diagonal and arranged such that said spring extends rearwardly away from said central section of said faceplate from a terminal point at or forwardly of said dished central section of said mask, such that when said spring is deflected, the distal end thereof travels on an arc inwardly toward the faceplate central axis;

whereby the mask, which is low in cost but inherently lacking in self-rigidity and stability due to its one-piece frameless construction, is suspended with high rigidity derived from said faceplate and with high stability to derive from the four-corner diagonal mounting, the ready accessibility of the distal ends readily accessible for facile insertion and removal of said mask from said faceplate.

6. An improved low cost mask-faceplate assembly for a shadow-mask-type color cathode ray tube, comprising:

a glass faceplate having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals, said mask having an integral rim-and-lip extending radially outward from the edge of said mask skirt to serve as an electron beam shield and to provide added stiffness to said mask, said rim-and-lip being cut out in the corner regions of said mask; and a corner mask suspension system for rigidly and stably suspending said mask with said dished perforate central section of said mask spaced from said central section of said faceplate consisting of four suspension devices, one at each corner of the mask, each device comprising:

a stud affixed to said faceplate flange on the associated faceplate diagonal and arranged to extend radially inwardly along said diagonal;

a bracket-spring assembly comprising a gull-wing-shaped bracket member having a planar central section and a pair of arms extending around the corner of said mask and beneath the overhang of said mask skirt, said arms being welded to the adjoining sides of the mask to strengthen the mask corner, said planar central section extending forwardly of said dished central section of said mask;

a leaf spring for detachably interconnecting said mask corner to said stud on said faceplate flange, said spring being welded to said central section of said bracket such that said spring is situated on said mask diagonal and normal to said diagonal and arranged such that said spring extends rearwardly of the mask for ready accessibility and away from said central section of said faceplate from a terminal point at or forwardly of said dished central section of said mask, such that when said spring is deflected, the distal end thereof travels on an arc inwardly toward the faceplate central axis and into said cut-out;

whereby the mask, which is low in cost but inherently lacking in self-rigidity and stability due to its one-piece frameless construction, is suspended with high rigidity derived from said faceplate and with high stability to derive from the four-corner diagonal mounting, the ready accessibility of the distal ends of the extending springs promoting facile insertion and removal of said mask from said faceplate.

7. An improved low cost mask-faceplate assembly for a shadow-mask-type color cathode ray tube, comprising:

a glass faceplate having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals, said mask having an integral rim extending radially outward from the edge of said mask skirt to serve as an electron beam shield and to provide added stiffness to said mask, said rim being cut out in the corner regions of said mask; and a corner mask suspension system for rigidly and stably suspending said mask with said dished perforate central section of said mask spaced from said central section of said faceplate, said suspension system consisting of four suspension devices, one at each corner of the mask, each device comprising:

a stud affixed to said faceplate flange on the associated faceplate diagonal and arranged to extend radially inwardly along said diagonal; a leaf spring for detachably interconnecting said mask corner to said stud on said faceplate flange, said spring constituting an integral part of a metal bracket-spring stamping, said stamping having arms extending around the corners of the mask and beneath the mask rim, said arms being welded to the adjoining sides of said mask to strengthen the mask corner and to support said springs on said mask diagonal and normal to said diagonal such that said spring extends rearwardly of the mask for ready accessibility, and away from said central section of said faceplate from a terminal point at or forewardly of said dished central section of said mask, such that when said spring is deflected, the distal end thereof travels on an arc inwardly toward the faceplate central axis and into said cut-out in said mask rim;

whereby the mask, which is low in cost but inherently lacking in self-rigidity and stability due to its one-piece frameless construction, is suspended with high rigidity derived from said faceplate and with high stability to derive from the four-corner diagonal mounting, the ready accessibility of the distal ends of the extending springs promoting facile insertion and removal of said mask frame from said faceplate.

* * * * *